US007007647B2

(12) United States Patent
Gaubatz et al.

(10) Patent No.: US 7,007,647 B2
(45) Date of Patent: Mar. 7, 2006

(54) ROTARY ACTUATOR DEVICE FOR CONTROLLING THE STROKE OF GAS CHARGE EXCHANGE VALVES IN THE CYLINDER HEAD OF AN INTERNAL COMBUSTION ENGINE

(75) Inventors: Karl-Heinz Gaubatz, Parsdorf (DE); Johannes Meyer, Karlsfeld (DE)

(73) Assignee: Bayerische Motoren Werke AG, Munich (DE)

( * ) Notice: Subject to any disclaimer, the term of this patent is extended or adjusted under 35 U.S.C. 154(b) by 0 days.

(21) Appl. No.: 11/128,303

(22) Filed: May 13, 2005

(65) Prior Publication Data

US 2005/0211211 A1 Sep. 29, 2005

Related U.S. Application Data

(63) Continuation of application No. PCT/EP03/11408, filed on Oct. 15, 2003.

(30) Foreign Application Priority Data

Nov. 14, 2002 (DE) ..... 102 52 997

(51) Int. Cl.
*F01L 1/00* (2006.01)

(52) U.S. Cl. ..... 123/90.21; 123/90.16; 123/90.39

(58) Field of Classification Search ..... 123/90.16, 123/90.39, 90.21, 90.6, 90.27, 90.22
See application file for complete search history.

(56) References Cited

U.S. PATENT DOCUMENTS

| | | | | |
|---|---|---|---|---|
| 3,563,215 | A | 2/1971 | Ross | |
| 4,494,729 | A | 1/1985 | Krueger | |
| 5,042,438 | A | 8/1991 | Heil et al. | |
| 5,605,077 | A | 2/1997 | Tsunoda et al. | |
| 2002/0152976 | A1 * | 10/2002 | Nguyen | 123/90.16 |
| 2004/0069259 | A1 * | 4/2004 | Shui et al. | 123/90.16 |
| 2004/0221824 | A1 | 11/2004 | Denteler et al. | |

FOREIGN PATENT DOCUMENTS

| | | |
|---|---|---|
| DE | 1 801 252 | 8/1969 |
| DE | 32 03 791 A1 | 8/1983 |
| DE | 39 32 293 C1 | 1/1991 |
| DE | 42 12 263 A1 | 10/1993 |
| DE | 43 27 068 A1 | 2/1995 |
| DE | 198 25 964 A1 | 12/1999 |
| DE | 101 40 461 A1 | 2/2003 |
| EP | 0 624 716 A1 | 11/1994 |
| EP | 0 979 928 A1 | 2/2000 |
| GB | 2 116 631 | 9/1983 |

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

A rotary actuator device is used to control the stroke of at least two gas exchange valves in a cylinder head of an internal combustion engine. The device includes first and second actuating mechanisms, first and second rocker motors, and a force transfer element. Each actuating mechanism is provided for at least one of the gas exchange valves of the engine. The first rocker motor has a first shaft on which the first actuating mechanism is disposed, and the second rocker motor has a second shaft on which the second actuating mechanism is disposed. The first and the second rocker motors are arranged in a point-mirrored relationship. The force transfer element is disposed between each actuating mechanism and the at least one gas exchange valve.

21 Claims, 2 Drawing Sheets

ROTARY ACTUATOR DEVICE FOR CONTROLLING THE STROKE OF GAS CHARGE EXCHANGE VALVES IN THE CYLINDER HEAD OF AN INTERNAL COMBUSTION ENGINE

CROSS REFERENCE TO RELATED APPLICATIONS

This application is a continuation of International Patent Application No. PCT/EP2003/011408, filed Oct. 15, 2003, designating the United States of America, and published in German as WO 2004/044391 A2, the entire disclosure of which is incorporated herein by reference. Priority is claimed based on German Patent Application No. 102 52 997.3, filed Nov. 14, 2002.

BACKGROUND AND SUMMARY OF THE INVENTION

The invention relates to a rotary actuator device for controlling the stroke of at least two equally acting gas charge exchange valves in a cylinder head of an internal combustion engine.

In German patent document DE 198 25 964 A1, a valve drive for an internal combustion engine is configured as a spring-and-mass vibrating system. It consists substantially of a rocker motor with a shaft running longitudinally in the cylinder head, as well as a lever-like exciter device for each gas charge exchange valve. The exciter devices can be coupled with the shaft according to the state of operation of the internal combustion engine. The rocker motor performs only a swiveling movement in the direction of a stroke of the gas charge exchange valve. The shaft and the exciter devices that can be coupled with it are a camshaft with releasable cams. At the end of each cam, at the point of contact with the gas charge exchange valve, a wheel is arranged so as to minimize friction. For all equally operating gas charge exchange valves, the valve drive has two rocker motors which are point-mirrored to one another, each with a corresponding camshaft.

Disadvantages of this embodiment are the great mass forces and the torques resulting therefrom which limit the maximum rotational speed of the internal combustion engine.

It is therefore a purpose of the present invention to reduce the driven masses in a valve drive.

This purpose is accomplished by a rotary actuator device that is used to control the stroke of at least two gas exchange valves in a cylinder head of an internal combustion engine. The device includes first and second actuating mechanisms, first and second rocker motors, and a force transfer element. Each actuating mechanism is provided for at least one of the gas exchange valves of the engine. The first rocker motor has a first shaft on which the first actuating mechanism is disposed, and the second rocker motor has a second shaft on which the second actuating mechanism is disposed. The first and the second rocker motors are arranged in a point-mirrored relationship. The force transfer element is disposed between each actuating mechanism and the at least one gas exchange valve.

Advantageously, the driven masses are reduced in the valve drive. By the reduction of the masses, the resultant moments and thus the mechanical stress on the entire valve drive are reduced, so that higher rotary speeds are possible.

Furthermore, the internal friction of the valve drive is substantially reduced, with the result that the fuel consumption of the internal combustion engine decreases.

In a preferred embodiment, a compact, small drive unit for two cylinders is produced. This unit can be developed into a modular concept so that this unit can be used with any internal combustion engine whose number of cylinders per cylinder row is divisible by 2. Selective structural adaptation of the particular internal combustion engine is unnecessary in this modular configuration.

Further, both the inlet and outlet sides of the individual cylinder pairs are constructed with the same modular units. Manufacturing costs are lowered by this measure.

In another preferred embodiment, in the case of a bilateral construction of the valve operating device, both on the intake and on the outlet end, only one parallel displacement of the rotary actuator device needs to be performed. Further adaptive work at the cylinder head is unnecessary.

A further preferred embodiment serves to reduce friction in the valve operation combined with the absence of free play in the valve drive components. The support of the force transfer element, at one end on the hydraulic valve play equalizing element and on the other end on a gas exchange valve, reduces the driven masses, since in this arrangement the hydraulic valve antibacklash element can be located in the cylinder head, thus simultaneously assuring a reliable and simple oil supply. In comparison with the state of the art, in which a tappet is arranged between the turning means and the gas exchange valve, the cup is entirely absent in the configuration according to the invention, so that this mass is absent from the driven valve train.

To achieve a compact construction, the axes of the spark plug bores can be made closer together on the length of a device in order to obtain the smallest possible compact unit for the rotary actuator device, combined with invariably good conditions for the installation and removal of the ignition device, such as a spark plug, for example. The size of an apparatus is still further with this method in modular construction.

In a still further embodiment, in which the stator of the rocker motor extends radially around the rotor by at least 180°, since in such a configuration the stator surrounding the rotor does not extend over 360° radially at the circumference. In this embodiment the greatest component compactness is achieved.

The invention is further explained hereinbelow with the aid of a preferred embodiment in two figures.

Figure 1:
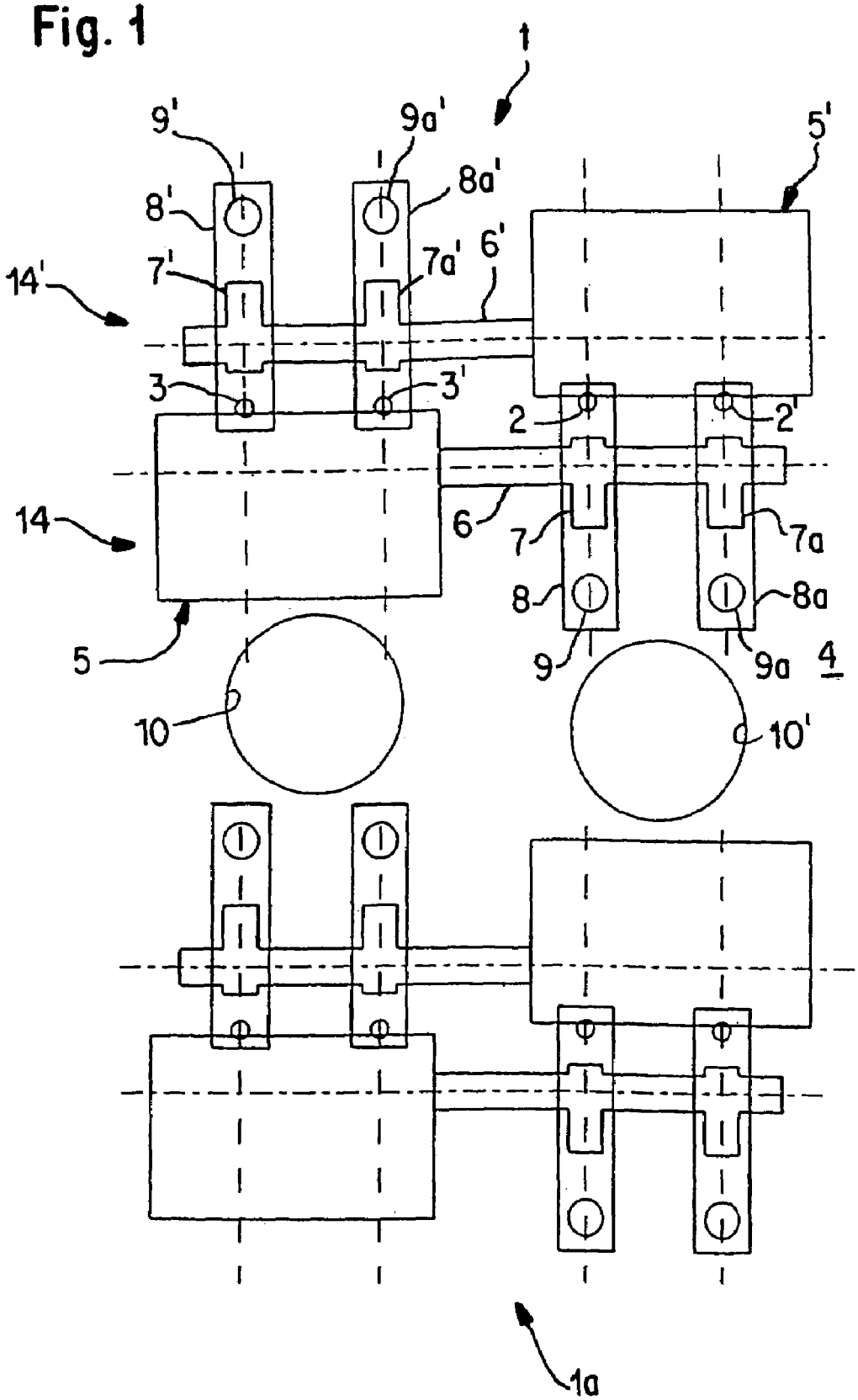
FIG. 1 shows a schematic representation of a plan view of two rotary actuator devices constructed on the intake side as well as the exhaust side of a cylinder head of an internal combustion engine.
Figure 2:
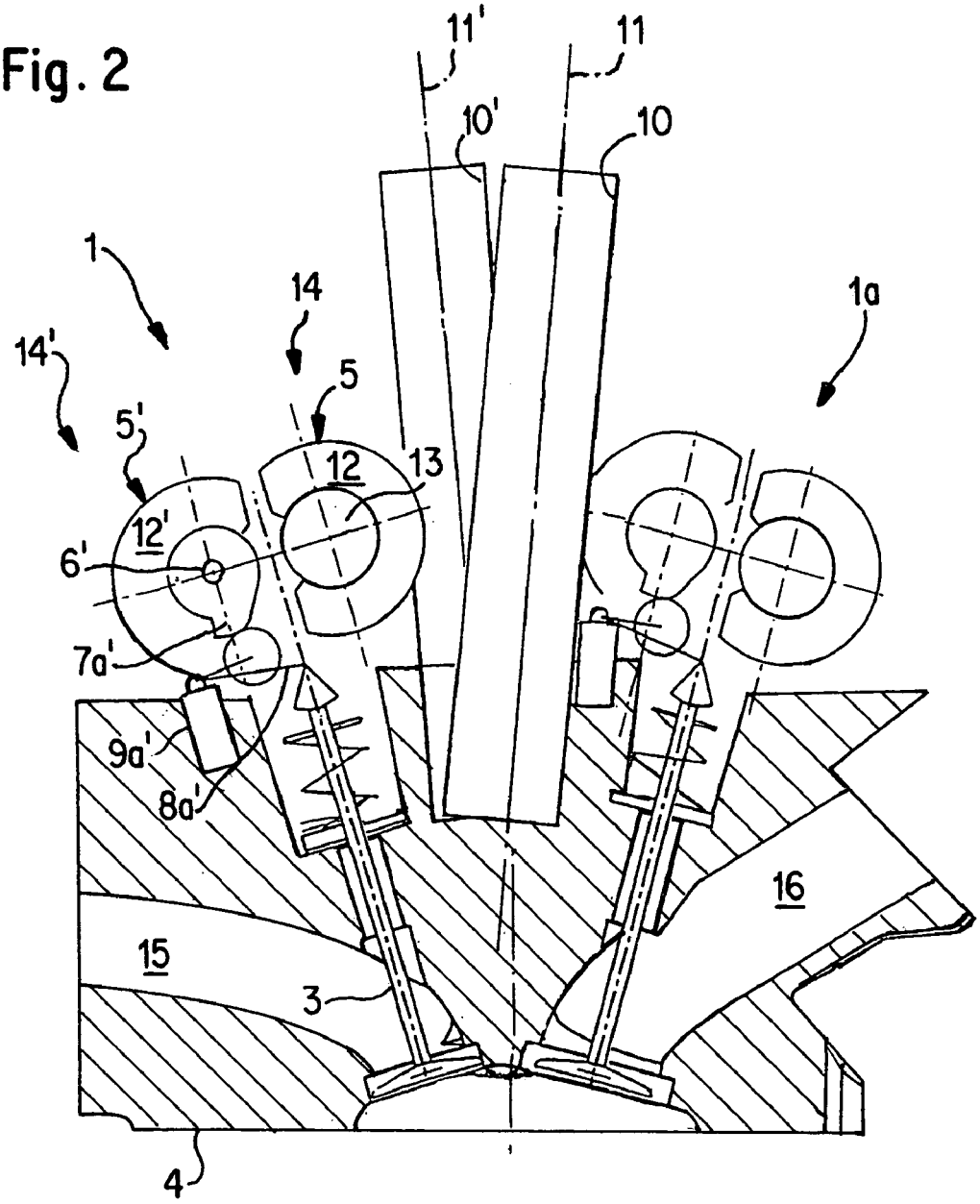
FIG. 2 shows a schematic representation of a side elevation of two rotary actuator devices built on the intake as well as on the exhaust side of a cylinder head of an internal combustion engine.

The reference numbers in FIG. 1 apply to the same components in FIG. 2.

DETAILED DESCRIPTION OF THE DRAWINGS

FIG. 1 shows a schematic plan view of two rotary actuator devices 1 and 1*a* constructed on a cylinder head 4 of an internal combustion engine, on the intake and on the exhaust side for controlling the stroke of four gas charge exchange valves 2, 2', 3, 3' all working the same way. The structure has the first rotary actuator device 1 and the second rotary actuator device 1*a* shifted parallel to the first. Between the rotary actuator devices 1 and 1*a* a first bore 10 and a second bore 10' are arranged in the cylinder head 4. The first bore 10 and the second bore 10' are each arranged centrally to a cylinder not shown. The first bore 10 and the second bore 10' serve to receive an ignition device, not shown, for each cylinder. The rotary actuator devices 1 and 1*a* are the same in construction and differ only in the place they are situated. The rotary actuator device 1 is provided for an intake side, the rotary actuator device 1*a* for an exhaust side of the internal combustion engine. Hereinafter only rotary actuator device 1 will be further explained, since all statements are applicable to the second rotary actuator device 1*a*.

Rotary actuator device 1 has essentially a first and a second half rotary actuator device 14, 14', point-mirrored to one another, for the stroke control of two gas exchange valves operating in the same manner. The first half rotary actuator device 14 includes a first rocker motor 5 with a first fixed shaft 6 on which the first actuating mechanisms 7 and 7*a* are fixedly arranged. The first actuating mechanisms 7, 7*a*, cams in this case, are in reciprocating action each with a first force transfer element 8, 8*a*. The force transfer elements 8, 8*a*, are supported on one side each on a first antibacklash element 9, 9*a*, and on the opposite side, each on a first gas change valve 2, 2'. The same applies also to the second half rotary actuator device 14'. The second half rotary device 14' has a second rocker motor 5' with a second fixed shaft 6'. On the second shaft 6' two additional second actuating mechanisms 7', 7*a*' are fixedly arranged. These are in alternating action with two second force transfer elements 8', 8*a*' which are again supported at one end on two second antibacklash elements 9, 9*a*' and at the other end on two second gas exchange valves 3, 3'.

In the present embodiment the rotary actuator device 1, including the first and second half rotary actuator devices 14, 14', is provided for two cylinders of the internal combustion engine. Each half rotary actuator device 14, 14' operates two identically acting gas exchange valves, here the intake gas exchange valves for two cylinders of the internal combustion engine. In a further embodiment a half rotary actuator device 14, 14' can be provided even for only a single gas change valve. Also possible is the use of a half rotary actuator device 14, 14' for two cylinders, each with only one identically acting gas exchange valve.

In the present embodiment the first gas exchange valves 2 and 2' and the second gas exchange valves 3 and 3' lie on one line, so that the first shaft 6 and the second shaft 6' and the first and the second half rotary actuator device 14, 14' are aligned parallel to one another. In additional variants the gas exchange valves, however, also can assume another position, so that slightly different geometrical arrangements are conceivable.

The first shaft 6 and the second shaft 6' are camshafts, and the first actuating elements 7, 7*a* and the second actuating elements 7', 7*a*' are cams. The first force transfer elements 8, 8*a* and the second force transfer elements 8', 8*a*' are rocker arms, but idler arms or cam followers can also be used. The first antibacklash elements 9, 9*a* and the second antibacklash elements 9', 9*a*' are hydraulic valve antibacklash elements which are preferably incorporated directly into the cylinder head 4. In this way a single hydraulic fluid supply is possible. All features which are represented for the rotary actuator device 1 apply also to the second rotary actuator device 1*a*.

FIG. 2 shows a schematic side view of the two rotary actuators 1 and 1*a*. Between rotary actuator 1 and the second rotary actuator 1*a* there is the first bore 10 for an ignition device, not shown, for the first cylinder. Since, as already described under FIG. 1, the two rotary actuator devices 1 and 1*a* are of the same construction and only point-mirrored to one another. Again only rotary actuator device 1 will be further explained below.

Above the valve shaft end of the gas exchange valve 3—an intake gas exchange valve—the first half of the rotary armature device 14 and the second rotary armature device 14' are fastened side by side to the cylinder head, the former near to the first bore 10, and the latter spaced further away from the first bore 10. On the first rocker motor 5 can be seen a first stator 12 and a first rotor 13; on the second rocker motor 5' only the second stator 12' can be seen, the second rotor 13' of which is concealed by the centrally disposed second shaft 6' as well as by the second actuating element 7*a*'. The actuating element 7*a*' lies on the schematically represented first force transmitting element 8*a*'. The force transmitting element 8*a*' is supported at one end on the antibacklash element 9*a*' and at the other end on the gas exchange valve 3 which is held in the cylinder head 4. The gas exchange valve 3 is shown in the open position, and in the closed position it closes an inlet passage 15 in the cylinder head 4. The corresponding exhaust gas exchange valve 2 is likewise shown in the open position and in the closed position shuts off an exhaust passage 16 in the cylinder head 4.

In order to achieve the greatest possible compactness and thus achieve a small size, the first stator 12 and the second stator 12' do not encompass the first rotor 13 and second rotor 13' respectively, on their entire circumference, but only to about 270°. The wrap-around is preferably greater than 180°, but always less than 360°, so that the parallel shafts 6 and 6' are closer together. This arrangement provides weight advantages in addition to packaging advantages. An additional reduction of the overall size is possible if the first bore 10 is brought closer to the first axis 11 and the second bore 10' to the second axis 11', since in the configuration according to the invention one gas exchange valve and one antibacklash element are opposite one another on the intake side and on the exhaust side and have different needs for space.)

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A rotary actuator device for controlling the stroke of at least two gas exchange valves in a cylinder head of an internal combustion engine, comprising:

a first actuating mechanism;

a second actuating mechanism, wherein each actuating mechanism is provided for at least one of the gas exchange valves of the engine;

a first rocker motor having a first shaft on which the first actuating mechanism is disposed;

a second rocker motor with a second shaft on which the second actuating mechanism is disposed, wherein the first and the second rocker motors are arranged in a point-mirrored relationship; and a force transfer element between each actuating mechanism and the at least one gas exchange valve.

2. The device according to claim 1, wherein the force transmitting element includes a rocker arm, an idler arm or a cam follower.

3. The device according to claim 2, further comprising:

an antibacklash element, wherein the force transfer element is supported at one end on the antibacklash element and at the other end on the at least one gas exchange valve.

4. The device according to claim 3, wherein the antibacklash element is a hydraulic valve antibacklash element.

5. The device according to claim 4, wherein the internal combustion engine has at least a first cylinder with a first ignition device in a bore in the cylinder head and a second cylinder with a second ignition device in a bore in the cylinder head, wherein at least a first shaft of the first bore and a second shaft of the second bore are crossed.

6. The device according to claim 5, wherein the rocker motor has a stator and a rotor, wherein the stator extends radially around the rotor at least by 180°.

7. The device according to claim 1, wherein the force transmitting element includes a rocker arm, an idler arm or a cam follower.

8. The device according to claim 1, further comprising:

an antibacklash element, wherein the force transfer element is supported at one end on the antibacklash element and at the other end on the at least one gas exchange valve.

9. The device according to claim 8, wherein the antibacklash element is a hydraulic valve antibacklash element.

10. The device according to claim 1, wherein the internal combustion engine has at least a first cylinder with a first ignition device in a bore in the cylinder head and a second cylinder with a second ignition device in a bore in the cylinder head, wherein at least a first shaft of the first bore and a second shaft of the second bore are crossed.

11. The device according to claim 1, wherein the rocker motor has a stator and a rotor, wherein the stator extends radially around the rotor at least by 180°.

12. Apparatus for controlling the stroke of at least two gas exchange valves in a cylinder head of an internal combustion engine having at least two cylinders, comprising:

at least one rotary actuator device including:

a first actuating mechanism;

a second actuating mechanism, wherein each actuating mechanism is provided for at least one of the gas exchange valves of the engine;

a first rocker motor having a first shaft on which the first actuating mechanism is disposed;

a second rocker motor with a second shaft on which the second actuating mechanism is disposed, wherein the first and the second rocker motors are arranged in a point-mirrored relationship; and a force transfer element between each actuating mechanism and the at least one gas exchange valve.

13. The apparatus according to claim 12, wherein at least one rotary actuator device is provided for two cylinders of the engine.

14. The apparatus according to claim 13, comprising at least first and second rotary actuator devices, wherein at least a first rotary actuator device is associated with an intake side of each cylinder and/or at least a second rotary actuator device is associated with an exhaust side of each cylinder.

15. The apparatus according to claim 14, wherein the second rotary actuator device is shifted parallel to the first rotary actuator device.

16. The device according to claim 1, wherein the force transmitting element includes a rocker arm, an idler arm or a cam follower.

17. The device according to claim 1, further comprising:

an antibacklash element, wherein the force transfer element is supported at one end on the antibacklash element and at the other end on the at least one gas exchange valve.

18. The device according to claim 17, wherein the antibacklash element is a hydraulic valve antibacklash element.

19. The device according to claim 1, wherein a first cylinder of the internal combustion engine has a first ignition device in a bore in the cylinder head and a second cylinder of the internal combustion engine has a second ignition device in a bore in the cylinder head, wherein at least a first shaft of the first bore and a second shaft of the second bore are crossed.

20. The apparatus according to claim 1, comprising at least first and second rotary actuator devices, wherein the two rotary actuating devices can be lined up in the direction of the longitudinal axis of the internal combustion engine.

21. The device according to claim 1, wherein the rocker motor has a stator and a rotor, wherein the stator extends radially around the rotor at least by 180°.

* * * * *